US008434838B2

(12) United States Patent
Zabbatino

(10) Patent No.: US 8,434,838 B2
(45) Date of Patent: May 7, 2013

(54) INDIVIDUAL LOCKER ASSEMBLY FOR REFRIGERATORS

(76) Inventor: Joseph Zabbatino, Brooklyn, NY (US)

( * ) Notice: Subject to any disclaimer, the term of this patent is extended or adjusted under 35 U.S.C. 154(b) by 255 days.

(21) Appl. No.: 13/028,769

(22) Filed: Feb. 16, 2011

(65) Prior Publication Data

US 2012/0206029 A1 Aug. 16, 2012

(51) Int. Cl.
*A47B 96/04* (2006.01)

(52) U.S. Cl.
USPC ..... 312/404; 312/108; 312/407.1; 62/252

(58) Field of Classification Search ..... 312/107, 312/108, 109, 111, 198, 199, 201, 404, 407, 312/407.1, 265.5, 291, 292, 293.1, 293.2, 312/293.3; 211/184, 10; 232/24, 44, 45, 232/25, 26; 70/63; 109/24, 45, 46, 47, 48, 109/49, 53, 54, 55, 56, 57; 62/252
See application file for complete search history.

(56) References Cited

U.S. PATENT DOCUMENTS

| | | | | | |
|---|---|---|---|---|---|
| 361,408 | A | * | 4/1887 | Gross | 109/56 |
| 1,382,837 | A | * | 6/1921 | Jurek | 312/291 |
| 1,630,160 | A | * | 5/1927 | Bayless | 312/291 |
| 1,733,794 | A | | 10/1929 | Goss | |
| 1,964,831 | A | * | 7/1934 | Rein | 312/408 |
| 2,051,733 | A | * | 8/1936 | Moore et al. | 62/265 |
| D138,391 | S | | 8/1944 | Baird | |
| 2,404,851 | A | | 7/1946 | Knowles et al. | |
| 2,421,439 | A | | 6/1947 | Smith | |
| 2,470,956 | A | * | 5/1949 | Savidge | 62/441 |
| 2,484,572 | A | | 10/1949 | Jude | |
| 2,776,035 | A | | 1/1957 | Hebel | |
| 3,120,413 | A | * | 2/1964 | Scotti | 312/330.1 |
| 3,700,300 | A | * | 10/1972 | Davis et al. | 312/240 |
| 4,062,302 | A | * | 12/1977 | Krizan | 108/60 |
| 4,153,311 | A | * | 5/1979 | Takahashi | 312/107 |
| 4,317,607 | A | | 3/1982 | Gomolka | |
| 5,031,974 | A | * | 7/1991 | Feucht et al. | 312/263 |
| 5,600,966 | A | * | 2/1997 | Valence et al. | 62/440 |

(Continued)

FOREIGN PATENT DOCUMENTS

| | | |
|---|---|---|
| FR | 2689221 | 10/1993 |
| GB | 2190137 | 11/1987 |

OTHER PUBLICATIONS

Website, http://www.thegreenhead.com/2009/11/fridge-locker-personal-food-security-system.php, Fridge Locker Personal Food Security system, two pages printed from the internet on Dec. 18, 2010.

*Primary Examiner* — James O Hansen
*Assistant Examiner* — Sasha T Varghese
(74) *Attorney, Agent, or Firm* — Richard C. Litman

(57) ABSTRACT

The individual locker assembly for refrigerators is intended for use in the workplace to permit employees to secure their perishable foods and beverages for lunches and snacks. The locker assembly is also suitable for installation in refrigerator units in medical offices and the like for the secure storage of controlled medications and the like that must be refrigerated. The locker assembly is assembled from top, bottom, side, and rear panels, and a series of intermediate shelves and dividers installed therein defining a plurality of individual storage compartments. Vertical panels include spring-biased pins that engage mating holes provided in the upper and lower interior panels of the refrigeration unit, to secure the assembly in place. Each compartment has its own lockable door. The locks may be combination units, key locks, external hasps and padlocks, or other lock types as desired. Integral locks may include provision for coin operation, if desired.

13 Claims, 4 Drawing Sheets

U.S. PATENT DOCUMENTS 5,605,047 A 2/1997 Park et al.
5,605,389 A * 2/1997 Kelly et al. ..... 312/258
5,910,163 A 6/1999 Schlamp
D529,055 S 9/2006 Okamoto et al.
2007/0075028 A1 * 4/2007 Nagel et al. ..... 211/59.2
2010/0256800 A1 10/2010 Heffron

* cited by examiner

INDIVIDUAL LOCKER ASSEMBLY FOR REFRIGERATORS

BACKGROUND OF THE INVENTION

1. Field of the Invention

The present invention relates to storage containers and the like, and particularly to an individual locker assembly for refrigerators. The lockers are installable within a standard or custom refrigerator and are individually securable to protect the contents therein.

2. Description of the Related Art

Refrigerators are commonly found in cafeteria and kitchenette areas in the workplace to allow employees to place perishable items therein for their lunches and snacks. While most employees are honest about such matters, there often seems to be one or more people who abuse the privilege of refrigerated storage for their goods, and who will take others' food and beverages stored in the refrigerator. In some instances, this has led to arguments and accusations as to whose goods were taken by whom. This is clearly disruptive in the workplace and has on occasion resulted in the employer installing surveillance equipment, sometimes resulting in official punishment or even the threat of job termination of employees by employers who become aware of such problems.

Another area in which refrigerators are commonly used in the workplace is in the medical field. Refrigerators are generally provided in medical offices, hospitals, and the like, and even veterinary offices for the proper storage of medicines and the like that require cold storage. Many of these medications require prescriptions to be legally dispensed, and while the vast majority of the staff having access to such supplies may very well be trustworthy, there is always some chance that such medicines and drugs may fall into the wrong hands if they are not properly secured. In some instances such refrigeration units for medical supplies are provided with a lock for the door. While this provides the desired security for those drugs and medications that require such, at least some of the supplies contained within the refrigerator may not need such security. This requires the person who needs such non-secure supplies to look up someone who has a key to unlock the refrigerator, each time such access is required.

Various secured refrigeration and freezer units have been developed in the past, ranging from commercial frozen food lockers to other smaller units. An example of such is found in French Patent No. 2,689,221, published on Oct. 1, 1993. This publication describes (according to the drawings and English abstract) an integrated refrigerated storage system having a plurality of separately lockable compartments and a single rearwardly disposed refrigeration unit.

None of the above inventions and patents, taken either singly or in combination, is seen to describe the instant invention as claimed. Thus, an individual locker assembly for refrigerators solving the aforementioned problems is desired.

SUMMARY OF THE INVENTION

The individual locker assembly for refrigerators comprises a series of top, bottom, side, and rear panels having another series of horizontal shelves and vertical dividers installing therein. The various panels, shelves and dividers define a plurality of individual storage units within the assembly. The panels, shelves and dividers have ventilation holes therethrough to provide for chilled air circulation throughout all of the compartments. Intermediate shelves and dividers have mating slots for engagement with one another. The two side panels and the rear panel have shelf support brackets extending inwardly therefrom.

Each unit has its own separably lockable front door. The locks may be of any practicable type, e.g., combination, key, external hasp and padlock, etc. Doors with integral locks may include provision for coin operation of the locks, if desired.

Spring-biased posts or pins extend from the upper and lower edges of the various vertical panels to engage mating holes in the upper and lower panels of the refrigeration unit, thereby locking the locker assembly in place within the refrigerator. The refrigerator may be a conventional unit, the locker assembly being installed in the refrigerator compartment once the refrigerator shelves have been removed, or the refrigerator may comprise a custom-configured unit devoid of a freezer compartment and configured for the installation of the locker assembly therein. The locker assembly may be assembled from a series of individual horizontal and vertical panels, or may alternatively be formed as an integral unit ready for installation in a compatible refrigerator.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The individual locker assembly for refrigerators comprises various embodiments of a locker assembly that provides for the secure individual storage of food, medication, and/or other articles within a refrigerator. The assembly includes a plurality of individually and independently openable and lockable units. Each of the units permits the person having access thereto to securely store and access materials therein as desired, without concern that others may take any such goods belonging to the person having access to the unit.

Figure 1:
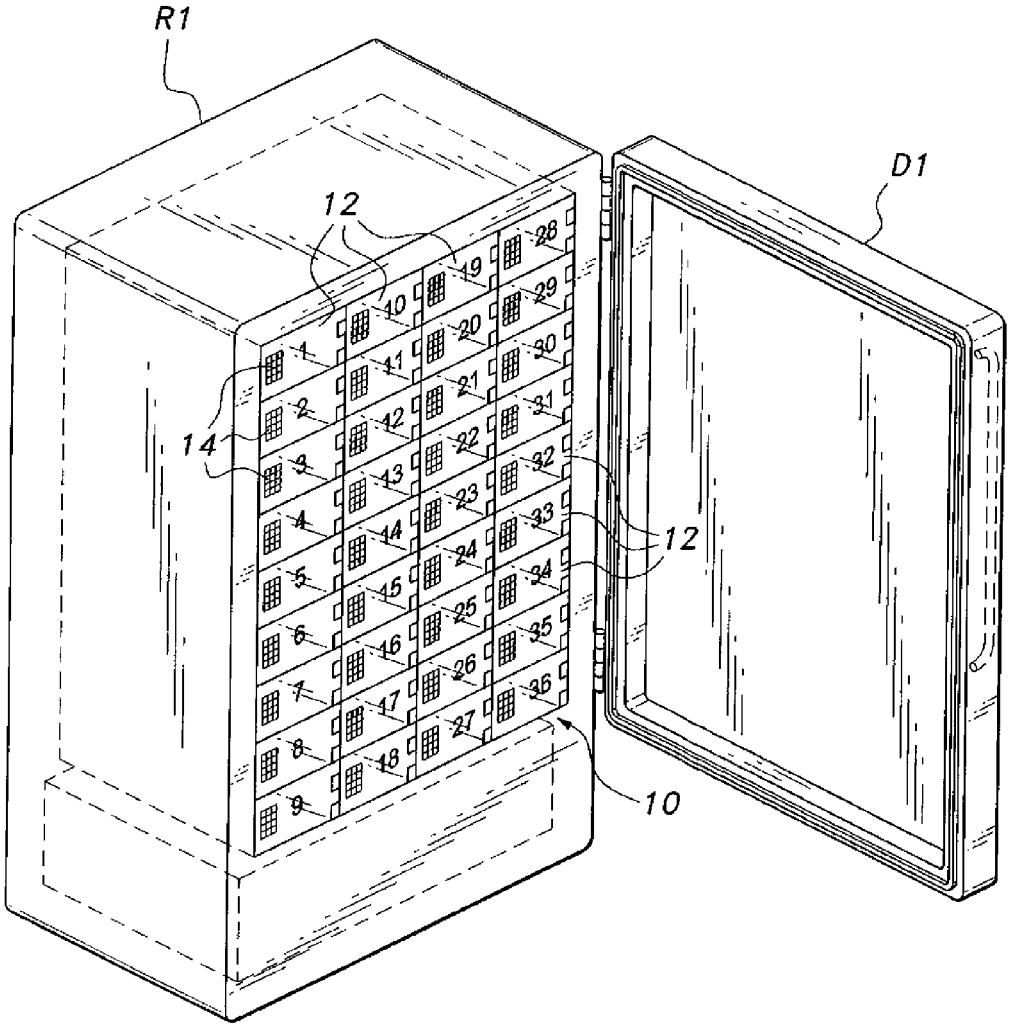
FIG. 1 is an environmental, perspective view of an individual locker assembly for refrigerators according to the present invention, the locker assembly being shown installed in a refrigerator.

FIG. 1 of the drawings is an illustration of an exemplary individual locker assembly 10, showing the assembly 10 installed in a refrigerator R1. The refrigerator R1 may be a specialized unit devoid of a separate freezer compartment, as the locker assembly 10 comprises a unitary construction when assembled and would generally only be installed within the portion of the refrigerator having temperatures above freezing. However, alternative constructions of the individual locker assembly may be configured for installation in conventional refrigerators having separate freezer compartments, as shown in FIG. 2 and discussed further below.

The individual locker assembly 10 is constructed from a plurality of horizontal and vertical panels to define a corresponding series of individual storage compartments 12. In the example of FIG. 1, a series of ten horizontal panels comprising a bottom panel, top panel, and eight intermediate shelves, and a set of six vertical panels comprising a left side panel, right side panel, rear panel, and three intermediate vertical panels, define a nine-by-four matrix of thirty-six individual storage compartments 12, each identified by a unique number. Alternatively, the locker assembly 10 (and the locker assembly 110 of FIG. 2) may be formed (e.g., molded, etc.) as a single integral structure, if desired.

Each storage compartment 12 has its own separate independently lockable door extending across the front opening. Each door is shown selectively secured by a push-button combination lock 14 in the example of FIG. 1, although other types of locks may be used. Opening the main door D1 of the refrigerator R1 provides access to all of the individual doors and locks of the locker assembly 10, allowing any individual assigned to any one of the units or compartments to access the lock and door thereto.

Figure 2:
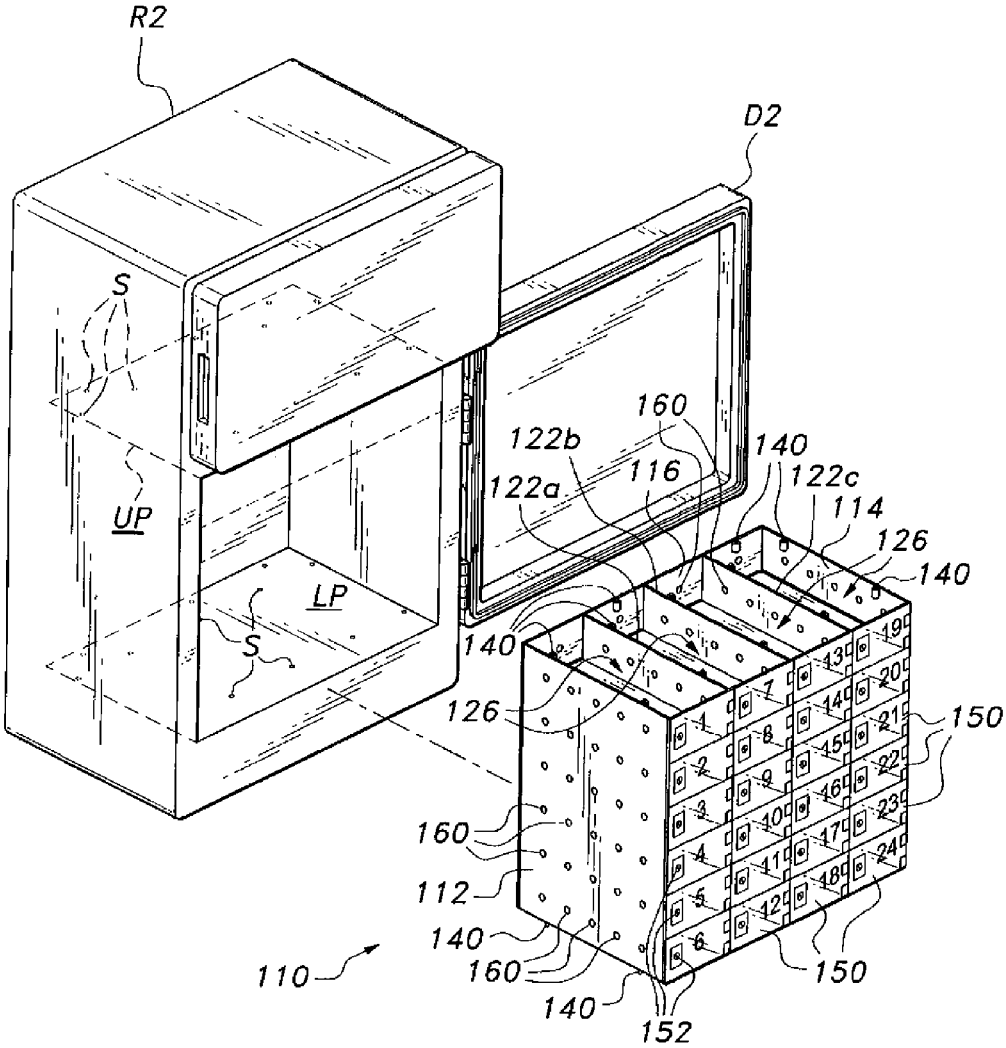
FIG. 2 is an exploded perspective view showing an alternative embodiment of an individual locker assembly for refrigerators according to the present invention, the assembly being shown removed from the interior of a refrigerator.
Figure 3:
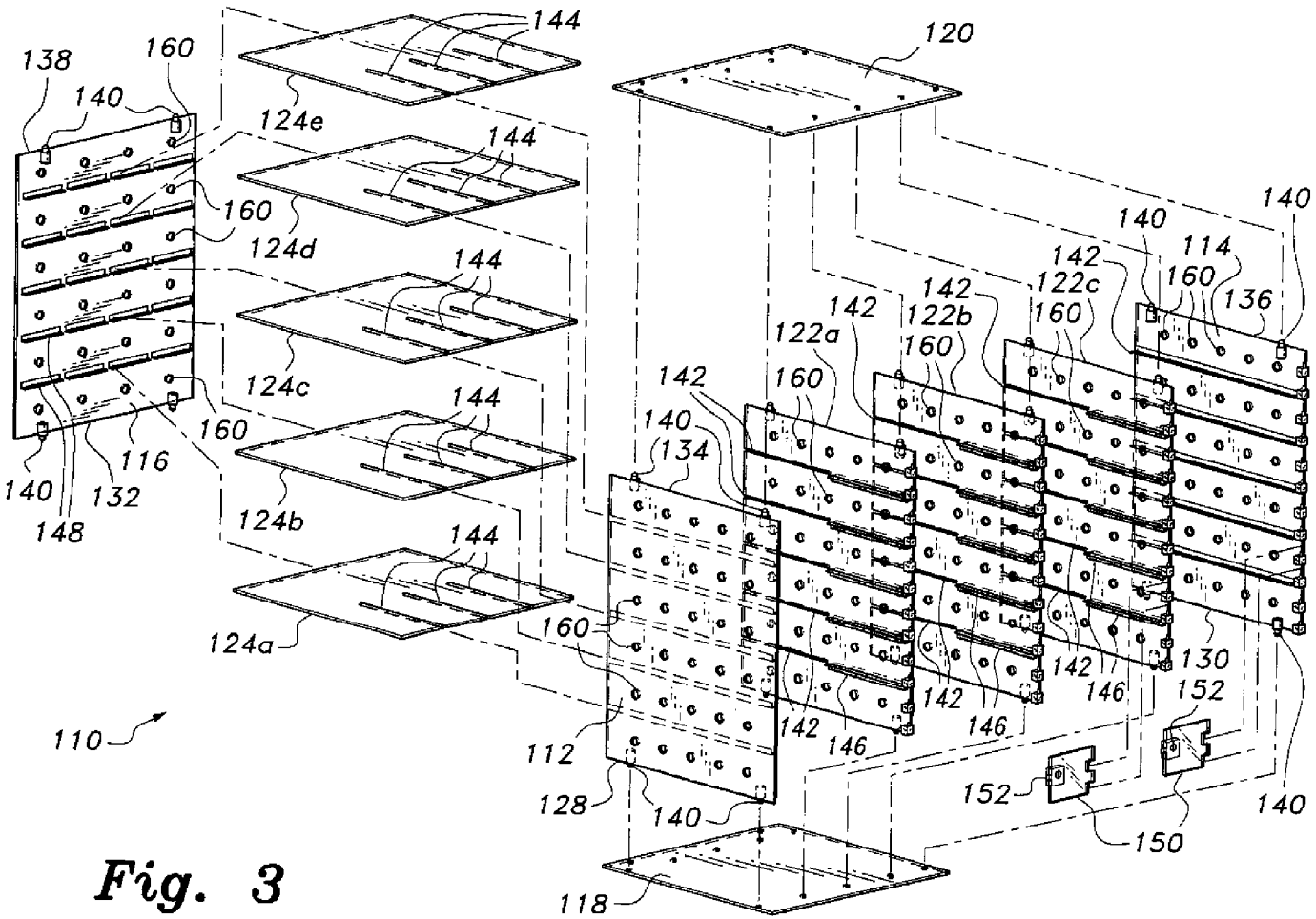
FIG. 3 is an exploded perspective view of an exemplary individual locker assembly for refrigerators according to the present invention, showing its various components.

FIG. 2 provides an exploded perspective view of an alternative embodiment of an individual locker assembly 110 separated from its refrigerator R2, while FIG. 3 provides an exploded perspective view of the individual components forming the locker assembly 110 with main refrigerator door D2 providing access to the individual doors of the locker assembly 110. The individual locker assembly 110 includes laterally opposed first and second side panels 112 and 114, a rear panel 116, a bottom panel 118, an opposite top panel 120 (removed in FIG. 2 to show the interior of the assembled locker assembly 110), one or more intermediate dividers, e.g., three such dividers 122*a* through 122*c* in the example of FIG. 3, and one or more intermediate shelves, e.g., five such shelves 124*a* through 124*e* in the example of FIG. 3. These various panels and shelves define a matrix comprising four compartments wide by six compartments high, or a total of twenty-four compartments. These compartments are designated by the reference numeral 126 in FIG. 2. The topmost row of compartments 126 is shown in FIG. 2 due to the removal of the top panel 120 in the drawing. It will be seen that the number of compartments may be adjusted, depending upon the number of intermediate panels and shelves used.

Each of the two side panels 112, 114 and the rear panel 116 have lower edges 128, 130, and 132, and opposite upper edges 134, 136, and 138. The bottom panel 118 spans the lower edges 128 through 132 of the side and rear panels 112 through 116, and the top panel spans the upper edges 134 through 138 of the side and rear panels. The upper and lower edges 128 through 138 of the side panels 112, 114 and the rear panel 116 also have a plurality of pins 140 extending therefrom. The pins 140 are urged outward from their respective edges by resilient springs or other suitable means. The refrigerators in which the individual locker assemblies are installed are adapted for such installation by having a corresponding plurality of locker engagement assembly receptacles or sockets S in their lower interior panels LP and upper interior panels UP, as shown in the exemplary refrigerator R2 of FIG. 2. The pins 140 lock into these corresponding receptacles or sockets S in the upper and lower interior panels LP and UP of the refrigerator, thus securing the individual locker assembly within the refrigerator. The pins 140 may be withdrawn for removal of the locker assembly, if desired, by opening the individual compartment doors along the upper and lower rows of compartments to access the pins.

Each of the intermediate dividers has a plurality of shelf engagement slots 142, which correspond in number to the number of intermediate shelves, that extend from the rear edge medially to about the middle of the divider. Similarly, each of the intermediate shelves has a plurality of divider engagement slots 144 therein, which correspond in number to the number of intermediate dividers, that extend from the front edge medially to about the middle of the shelf. The slots 144 in the intermediate shelves, e.g., shelves 124*a* through 124*e*, are slid into the slots 142 of the intermediate dividers, e.g., dividers 122*a* through 122*c*, to interlock to form an orthogonal matrix of shelves and dividers. Each of the dividers 122*a* through 122*e* and the parallel side panels 112 and 114 includes flanges 146 (e.g., angles attached to the surfaces of the dividers and panels, with one leg thereof extending laterally) or other shelf supports that extend from about the middle of the divider or panel to the front to support the edges of the shelves in the front half of the assembly 110. Similarly, the rear panel 116 includes a plurality of flanges 148 on its front face to support the rearward edges of the shelves.

Each of the compartments 126 formed by the assembly of the various panels and shelves has a front having a door 150 selectively extending thereacross. The doors 150 are preferably formed of a transparent plastic material to enable the users of the device to see what foods or other materials they have left in their individual locker compartments (if any) prior to unlocking and opening their compartments. The doors 150 are pivotally attached to an adjacent forward edge of one of the side panels, e.g., the second side panel 114, or to the forward edge of one of the intermediate panels 122*a* through 122*c*, using a conventional hinge arrangement. The hinge components affixed to the side and intermediate panels may include upwardly extending pintles that engage corresponding passages in lugs along the hinge attachment side or edge of each door, allowing the doors 150 to be lifted from the pintles for removal when the entire individual locker assembly 110 is removed from its refrigerator. Much the same structure is provided for the doors of the locker assembly 10 of FIG. 1. The opposite edge of each door includes some means for locking the door to the front of the corresponding side panel or intermediate panel, depending upon the location of the door. In the example of FIG. 1 the locks 14 are push-button combination locks, as described further above in the discussion of the individual lock assembly 10 of FIG. 1. In the example of FIGS. 2 and 3, each lock 152 comprises a key actuated lock. It will be seen that any practicable lock may be installed.

Figure 4:
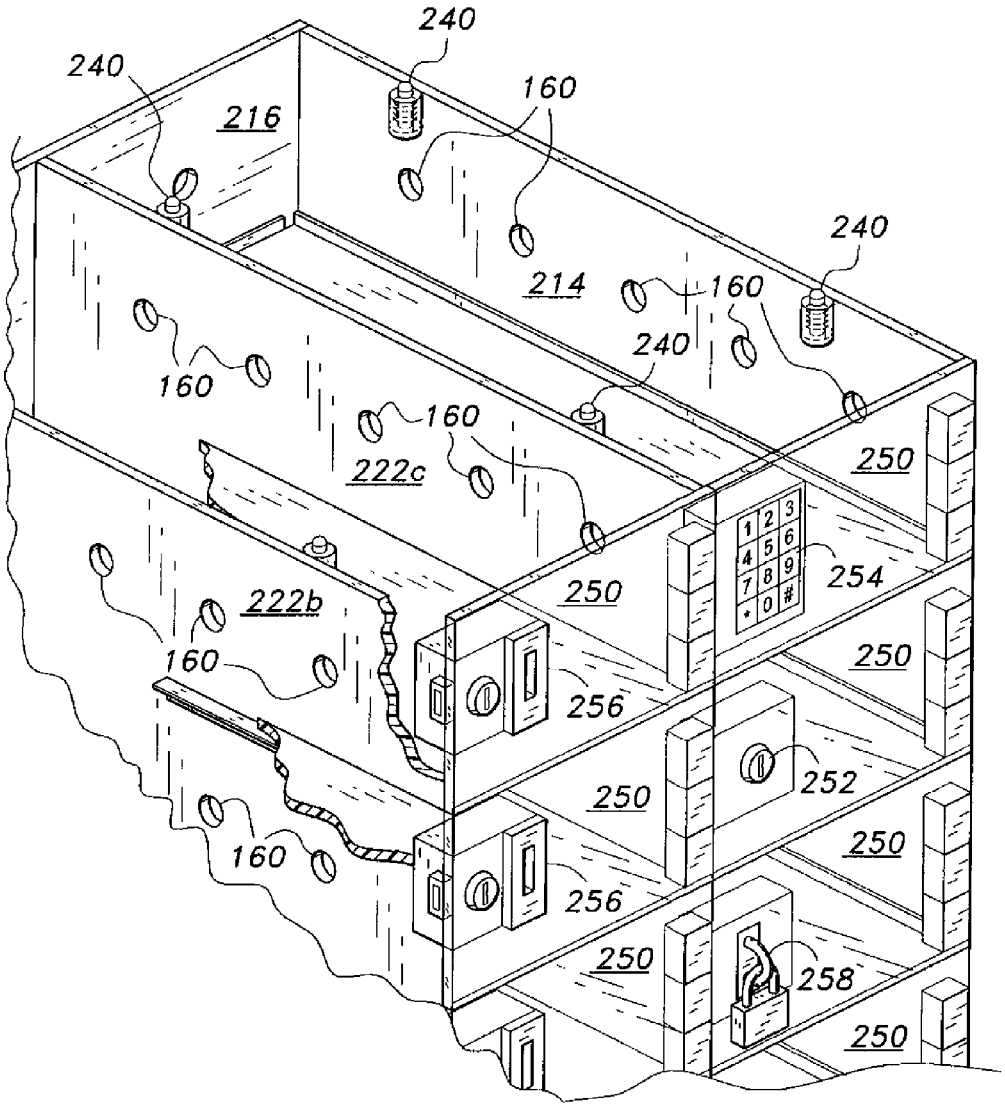
FIG. 4 is a partial perspective view of an individual locker assembly for refrigerators according to the present invention, broken away and partially in section to show details thereof.

FIG. 4 provides a perspective view of another exemplary individual locker assembly, broken away so that portions of the second side panel 214, rear panel 216, intermediate panels 222*b* and 222*c*, and intermediate shelves, similar to the intermediate shelves 124*a* through 124*e* seen in FIG. 3, are visible. The reference numerals of the components illustrated in FIG. 4 correspond to like components in the locker assembly 110 of FIGS. 2 and 3, but with the leftmost (hundreds) digit being a 2 in the example of FIG. 4, rather than a 1 as in the example of FIGS. 2 and 3. The side panel 214 and intermediate panels 222*b*, 222*c* also have resiliently disposed pins 240 extending upward to engage corresponding receptacles in the upper interior panel of the refrigerator. A variety of different locks are shown installed on the doors 250 of the locker assembly portion illustrated in FIG. 4. For example, a pushbutton combination lock 254 is illustrated as the locking means for the upper right door in FIG. 4. Alternatively, a key-type lock 252 is installed on the door immediately below the pushbutton combination lock 254. The vertical row of doors that close off the compartments between the intermediate dividers 222*b* and 222*c* each has a coin-operated key-type lock 256 installed therein. In some instances it may be desirable for the owner or operator of the locker assembly to collect some payment for the use of the device, and the installation of coin-operated locks will permit such collection. It will be seen that such coin-operated locks are conventional, and for that matter other types of coin-operated locks (dial or pushbutton combination, etc.) may be installed with any of the embodiment of the individual locker assembly. In addition, or in lieu of the above lock types, a simple hasp and staple 258 may be installed, with the user of each locker compartment providing his or her own lock (combination or key-type padlock, etc.). It should be noted that the various types of locks illustrated in FIG. 4 would not likely be used with a single individual locker assembly, as shown in FIG. 4. Rather, FIG. 4 is used to show the variety of different lock types that may be used with the locker assembly.

The individual locker assemblies in any of their embodiments may be provided as a series of individual flat panels to be assembled to form the completed structure, or may alternatively be formed as a unitary structure ready for installation in a compatible refrigerator. The individual locker assemblies may be constructed to provide any practicable number of individual compartments therein, the sizes of the compartments depending upon the spacing between shelf and divider slots and flanges and the corresponding supports and flanges of the side and rear panels. The various panels, dividers, and shelves are preferably formed of sheet plastic for economy and durability, although other materials (e.g., sheet metal, wood, composite sheet material) may be used. Each of the various vertical panels, i.e., side panels, rear panel, and dividers, is provided with a plurality of ventilation passages therethrough, e.g., passages 160 of the individual locker assembly of FIGS. 2, 3, or 4. Such ventilation passages provide for the circulation of cold air through all of the compartments of the device, thereby keeping food and/or other goods that require refrigeration, fresh until used.

It is to be understood that the present invention is not limited to the embodiments described above, but encompasses any and all embodiments within the scope of the following claims.

I claim:

1. An individual locker assembly for a refrigerator, the refrigerator having a lower interior panel and an upper interior panel, the lower interior panel and the upper interior panel each including a plurality of locker assembly engagement receptacles therein, the individual locker assembly comprising:

a first side panel having an upper edge and a lower edge opposite the upper edge;

a second side panel disposed laterally opposite the first side panel, the second side panel having an upper edge and a lower edge opposite the upper edge;

a rear panel extending between the first side panel and the second side panel, the rear panel having an upper edge and a lower edge opposite the upper edge;

a bottom panel extending between the lower edge of first side panel and the lower edge of the second side panel;

a top panel extending between the upper edge of the first side panel and the upper edge of the second side panel;

a plurality of resiliently extendible pins extending from the upper edges and the lower edges of the first side panel, the second side panel, and the rear panel, respectively, the pins being adapted for engaging corresponding locker assembly engagement receptacles in the bottom panel and the top panel;

a plurality of intermediate dividers disposed between the first side panel and the second side panel, each of the intermediate dividers having a plurality of shelf engagement slots defined therein extending from a rear edge into the divider;

a plurality of intermediate shelves disposed between the bottom panel and the top panel, so that the first side panel, the second side panel, the rear panel, the top panel, the bottom panel, the plurality of intermediate dividers, and the plurality of intermediate shelves define a plurality of individual compartments, each of the compartments having a front, each of the intermediate shelves having a plurality of divider engagement slots defined therein extending from a front edge into the shelf, the divider engagement slots engaging the shelves and the shelf engagement slots engaging the dividers to orthogonally interlock the dividers and the shelves to form walls of the compartments;

a plurality of mutually independent lockable doors extending across the corresponding front of each of the compartments, respectively; and wherein the first side panel, the second side panel, the rear panel, and the plurality of intermediate dividers include a plurality of ventilation passages disposed therethrough to accommodate the flow of refrigerated air through the locker assembly.

2. The individual locker assembly for refrigerator according to claim 1, wherein:

each of the shelf engagement slots extend from the rear edge medially into the divider; and each of the divider engagement slots extend from the front edge medially into the shelf.

3. The individual locker assembly for refrigerator according to claim 1, further comprising a refrigerator in combination therewith, the refrigerator having a lower interior panel and an upper interior panel, the lower interior panel and the upper interior panel each including a plurality of locker assembly engagement receptacles therein, said pins engaging the plurality of locker assembly engagement receptacles in lower interior panel and the upper interior panel, respectively, to secure the locker assembly in the refrigerator.

4. The individual locker assembly for a refrigerator according to claim 1, further comprising a lock disposed at each of the doors of each of the compartments, the lock being selected from the group consisting of combination locks, key operated locks, and coin operated locks.

5. The individual locker assembly for a refrigerator according to claim 1, further comprising:

a hasp affixed to at least one of the lockable doors of the compartments; and a staple extending from the front of the corresponding one of the compartments.

6. The individual locker assembly for a refrigerator according to claim 1, wherein:

each of the panels, dividers, and shelves is formed of plastic.

7. The individual locker assembly for a refrigerator according to claim 1, wherein each of the doors is transparent.

8. An individual locker assembly for a refrigerator, the refrigerator having a lower interior panel and an upper interior panel, the lower interior panel and the upper interior panel each including a plurality of locker assembly engagement receptacles therein, the individual locker assembly comprising:

a first side panel having an upper edge and a lower edge opposite the upper edge;

a second side panel disposed laterally opposite the first side panel, the second side panel having an upper edge and a lower edge opposite the upper edge;

a rear panel extending between the first side panel and the second side panel, the rear panel having an upper edge and a lower edge opposite the upper edge;

a bottom panel extending between the lower edge of first side panel and the lower edge of the second side panel;

a top panel extending between the upper edge of the first side panel and the upper edge of the second side panel;

a plurality of fasteners extending from the upper edges and the lower edges of the first side panel, the second side panel, and the rear panel, respectively, the fasteners being adapted for engaging corresponding locker assembly engagement receptacles in the bottom panel and the top panel;

a plurality of intermediate dividers disposed between the first side panel and the second side panel, each of the intermediate dividers having a plurality of shelf engagement slots defined therein extending from a rear edge into the divider;

a plurality of intermediate shelves disposed between the bottom panel and the top panel, so that the first side panel, the second side panel, the rear panel, the top panel, the bottom panel, the plurality of intermediate dividers, and the plurality of intermediate shelves define a plurality of individual compartments, each of the compartments having a front, each of the intermediate shelves having a plurality of divider engagement slots defined therein extending from a front edge into the shelf, the divider slots engaging the shelves and the shelf engagements slots engaging the dividers to orthogonally interlock the dividers and the shelves to form walls of the compartments; a plurality of mutually independent lockable doors extending across the corresponding front of each of the compartments, respectively; and wherein each of the first side panel, the second side panel, the rear panel, and the plurality of intermediate dividers includes a plurality of ventilation passages disposed therethrough to accommodate the flow of refrigerated air through the locker assembly.

9. The individual locker assembly for a refrigerator according to claim 8, further comprising a lock disposed at each of the doors of each of the compartments, the lock being selected from the group consisting of combination locks, key operated locks, and coin operated locks.

10. The individual locker assembly for a refrigerator according to claim 8, further comprising:

a hasp affixed to at least one of the lockable doors of the compartments; and a staple extending from the front of the corresponding one of the compartments.

11. The individual locker assembly for a refrigerator according to claim 8, wherein each of the panels, dividers, and shelves is formed of plastic.

12. The individual locker assembly for a refrigerator according to claim 8, wherein each of the doors is transparent.

13. The individual locker assembly for a refrigerator according to claim 8, wherein:

each of the shelf engagement slots extend from the rear edge medially into the divider; and each of the divider engagement slots extend from the front edge medially into the shelf.

* * * * *